US009711910B2

(12) United States Patent
Zhao et al.

(10) Patent No.: US 9,711,910 B2
(45) Date of Patent: Jul. 18, 2017

(54) WATERPROOF ELECTRICAL CONNECTOR ASSEMBLY AND METHOD OF MANUFACTURING SAME

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/011,673

(22) Filed: Feb. 1, 2016

(65) Prior Publication Data

US 2016/0233594 A1 Aug. 11, 2016

(30) Foreign Application Priority Data

Feb. 11, 2015 (CN) ..... 2015 1 0069505

(51) Int. Cl.
*H01R 13/6581* (2011.01)
*H01R 13/52* (2006.01)

(52) U.S. Cl.
CPC ..... *H01R 13/6581* (2013.01); *H01R 13/5202* (2013.01)

(58) Field of Classification Search
USPC ..... 439/83, 78, 660, 626, 271, 607.35, 439/607.36
See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,388,380 | B1 * | 3/2013 | Van der Steen | H01R 13/5202 439/607.36 |
| 8,827,742 | B2 | 9/2014 | Wang | |
| 8,956,187 | B2 * | 2/2015 | He | H01R 13/504 439/607.35 |
| 9,257,801 | B2 * | 2/2016 | Fang | H01R 13/6587 |
| 9,385,484 | B2 * | 7/2016 | Chen | H01R 13/6582 |
| 9,413,098 | B2 * | 8/2016 | Chien | H01R 13/5202 |

(Continued)

FOREIGN PATENT DOCUMENTS

| | | |
|---|---|---|
| CN | 203983548 | 12/2014 |
| JP | 2013054844 | 3/2013 |
| WO | 2012124261 | 9/2012 |

*Primary Examiner* — Alexander Gilman
(74) *Attorney, Agent, or Firm* — Wei Te Chung; Ming Chieh Chang

(57) ABSTRACT

A waterproof electrical connector assembly includes: an insulative housing; plural contacts retained to the housing; a metallic shield secured to the housing; an insulative cover enclosing the shield to define a rear chamber; a substrate connected to the contacts and having an edge portion, the edge portion extending forwardly into the rear chamber; and a sealing member filling the rear chamber. A method for manufacturing such a waterproof electrical connector assembly includes: mounting a metallic shield to a combined insulative housing and electrical contacts; connecting a substrate to the electrical contacts; enclosing an insulative cover over the shield and an edge portion of the substrate to define a chamber; and sealing the chamber.

11 Claims, 8 Drawing Sheets

(56) References Cited

U.S. PATENT DOCUMENTS

| | | | | |
|---|---|---|---|---|
| 9,444,177 | B2 * | 9/2016 | Tsai | H01R 13/5202 |
| 2011/0312223 | A1 * | 12/2011 | Wang | H01R 27/00<br>439/626 |
| 2012/0108095 | A1 * | 5/2012 | Liu | H01R 13/5219<br>439/271 |
| 2012/0231661 | A1 * | 9/2012 | Song | H01R 23/6873<br>439/607.4 |
| 2012/0315557 | A1 * | 12/2012 | Paik | H01M 8/04231<br>429/415 |
| 2012/0315779 | A1 * | 12/2012 | Yudate | H01R 12/724<br>439/271 |
| 2013/0183844 | A1 * | 7/2013 | Wang | H01R 24/68<br>439/271 |
| 2014/0302709 | A1 * | 10/2014 | Zhao | H01R 12/57<br>439/519 |
| 2014/0315439 | A1 * | 10/2014 | Zhang | H01R 13/516<br>439/626 |
| 2014/0349514 | A1 * | 11/2014 | Yang | H01R 13/6581<br>439/487 |
| 2015/0244099 | A1 * | 8/2015 | Lee | H01R 13/508<br>439/660 |
| 2015/0255905 | A1 * | 9/2015 | Little | H01R 13/6658<br>439/78 |
| 2015/0325944 | A1 * | 11/2015 | Chien | H01R 13/5202<br>439/271 |
| 2016/0294105 | A1 * | 10/2016 | Zhao | H01R 13/5202 |

* cited by examiner

WATERPROOF ELECTRICAL CONNECTOR ASSEMBLY AND METHOD OF MANUFACTURING SAME

BACKGROUND OF THE INVENTION

1. Field of the Invention

The present invention relates to a waterproof electrical connector assembly, and more particularly to a sealing structure which is effectuated after contacts thereof are soldered to a printed circuit board thereof and associated method.

2. Description of Related Art

China Patent No. 203932465, issued on Nov. 5, 2014, discloses a waterproof electrical connector including an insulative body, a metal shell, a plurality of terminals, a metal plate, a front waterproof rubber ring, and a rear waterproof rubber. After the rear waterproof rubber is applied and solidified, the waterproof electrical connector is ready to be mounted to a printed circuit board (PCB), e.g., by soldering the terminals to conductive pads of the PCB. U.S. Patent Application Publication No. 2012/0315779, published on Dec. 3, 2012, discloses a waterproof connector including a front seal and a rear seal such as an adhesive or bonding material. Similarly, such waterproof connector is ready to be mounted to an external substrate or PCB. During mounting the waterproof connector to a PCB, heat generated e.g., by reflowing, might have an adverse impact on the rear seal or rubber.

A waterproof connector assembly having an effective sealing structure is desired.

SUMMARY OF THE INVENTION

A waterproof electrical connector assembly comprises: an insulative housing; a plurality of contacts retained to the housing; a metallic shield secured to the housing; an insulative cover enclosing the shield to define a rear chamber; a substrate connected to the contacts and having an edge portion, the edge portion extending forwardly into the rear chamber; and a sealing member filling the rear chamber. A method for manufacturing such a waterproof electrical connector assembly comprises the steps of: mounting a metallic shield to a combined insulative housing and electrical contacts; connecting a substrate to the electrical contacts; enclosing an insulative cover over the shield and an edge portion of the substrate to define a chamber; and sealing the chamber. By connecting the substrate to the contacts prior to applying or forming the sealing member, integrity of the sealing member is secured.

DETAILED DESCRIPTION OF THE PREFERRED EMBODIMENT

Figure 1:
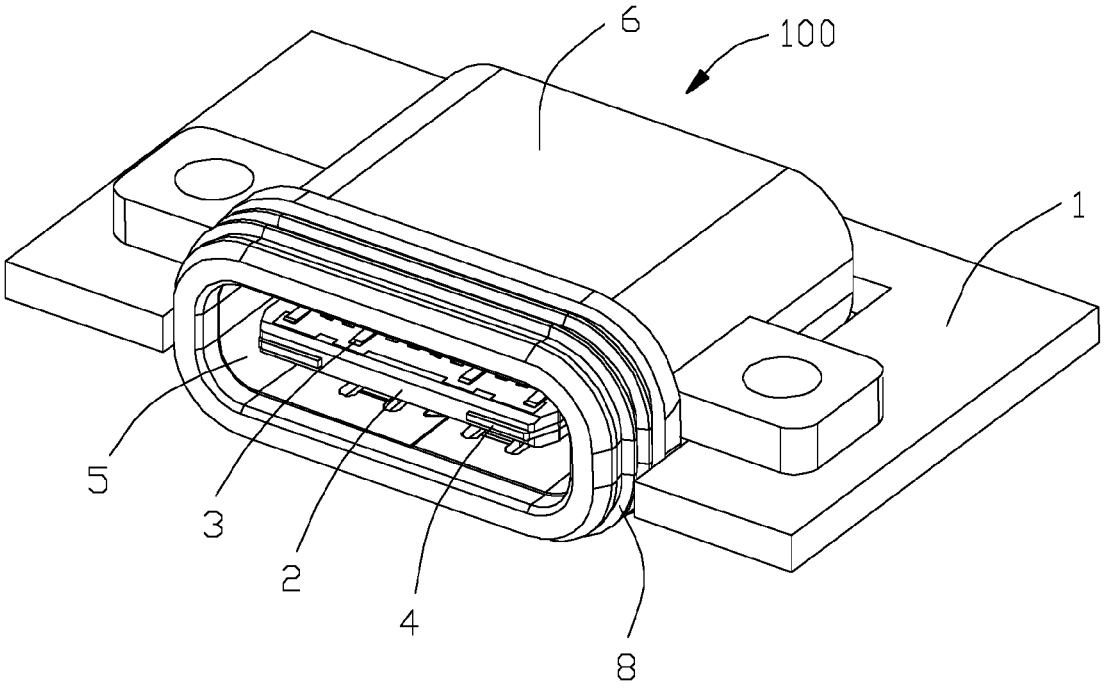
FIG. 1 is a front perspective view showing an electrical connector assembly in accordance with the present invention.

Referring to FIGS. 1 through 8, an electrical connector assembly 100 includes an insulative housing 2, a plurality of contacts 3 retained to the housing 2 as a terminal module, a metallic shield 5 secured to the housing 2 to form a mating cavity for receiving a plug, and a printed circuit board or substrate 1 to which the contacts 3 are mounted. The electrical connector assembly 100 further includes an insulative cover 6 enclosing the shield 5, and a sealing member 7, e.g., a bonding material, glue, epoxy, etc., at a rear of the shield 5. The cover 6 is so mounted to enclose the housing 2 and the shield 5 as to define a chamber 61 for forming the sealing member 7 after the contacts 3 are mounted to the substrate 1, e.g., by surface-mount soldering, through-hole inserting, etc. The substrate 1 has a front edge portion extending into the chamber 61.

Referring specifically to FIGS. 3-8, the electrical connector assembly 100 further includes a metal plate 4. The housing 2 includes an upper piece 23 and a lower piece 24 separated by the plate 4 and a base 25. The upper piece 23 is insert-molded with associated contacts 31 as an upper terminal module, and the lower piece 24 is insert-molded with associated contacts 32 as a lower terminal module. After combining the upper and lower pieces 23 and 24 with the plate 4 therebetween, the base 25 is formed by a second molding process so as to form the complete housing 2 with the contacts 3 therein.

The housing 2 has an upper surface 21 at the upper piece 23 and a lower surface 22 at the lower piece 24. The upper piece 23 has a tongue 231, the lower piece 24 has a tongue 241, and the base 25 has a tongue 251.

Referring again to FIGS. 3-8, each of the upper row of contacts 31 has a contacting portion 311 exposed to the upper surface 21, a soldering portion 313, and an intermediate portion 312. Each of the lower row of contacts 32 has corresponding contacting portion 321, soldering portion 323, and intermediate portion 322.

The soldering portions 313 and 323 of the upper and lower rows of contacts 31 and 32 extend behind respective rear ends of the upper and lower pieces 23 and 24.

Referring specifically to FIGS. 1-4 and 7-8, the insulative cover 6 is a sleeve-like member and has a lengthwise dimension greater than either the housing 2 or the shield 5. The insulative cover 6 is mounted to the shield 5 after the upper and lower rows of contacts 31 and 32 are soldered to the substrate 1. The chamber 61 is defined at a rear of the cover 6 and extends forwardly to a rear of the base 25. The substrate 1 has an edge portion extending into the chamber 61. The cover 6 has a pair of inner grooves 62 for accommodating a part of the substrate edge portion. A waterproof ring or seal 8 is provided around a front of the cover 6.

Figure 2:
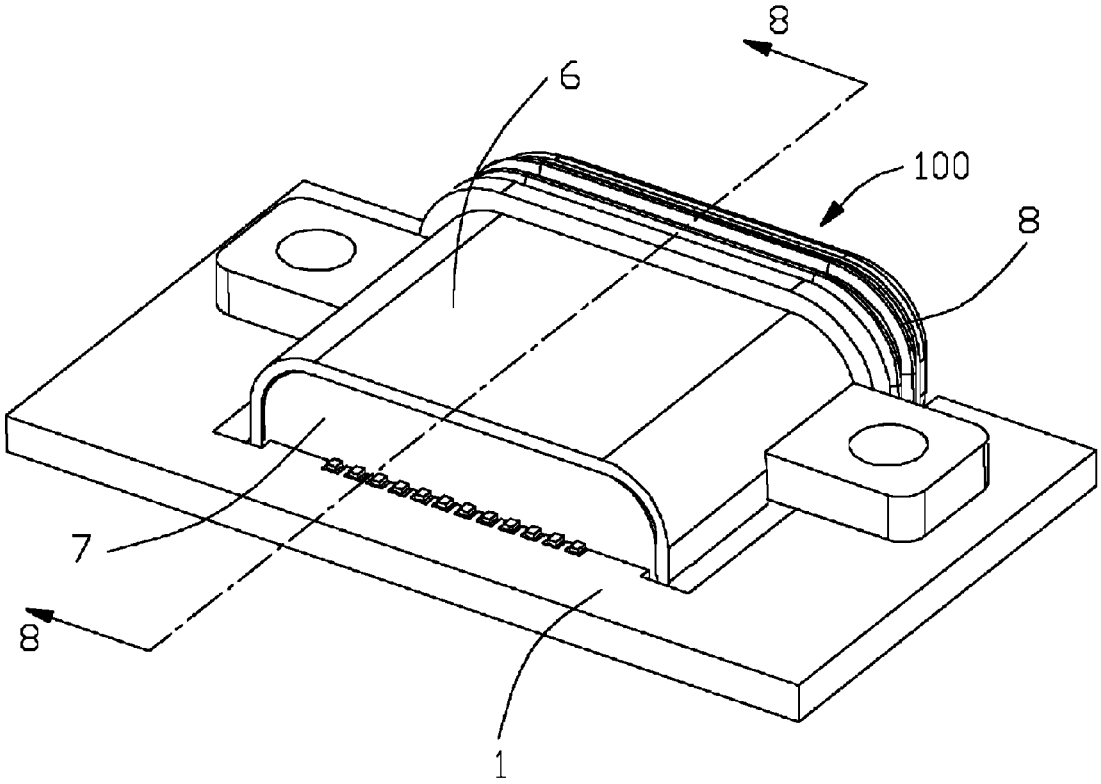
FIG. 2 is a rear perspective view of the electrical connector assembly.
Figure 3:
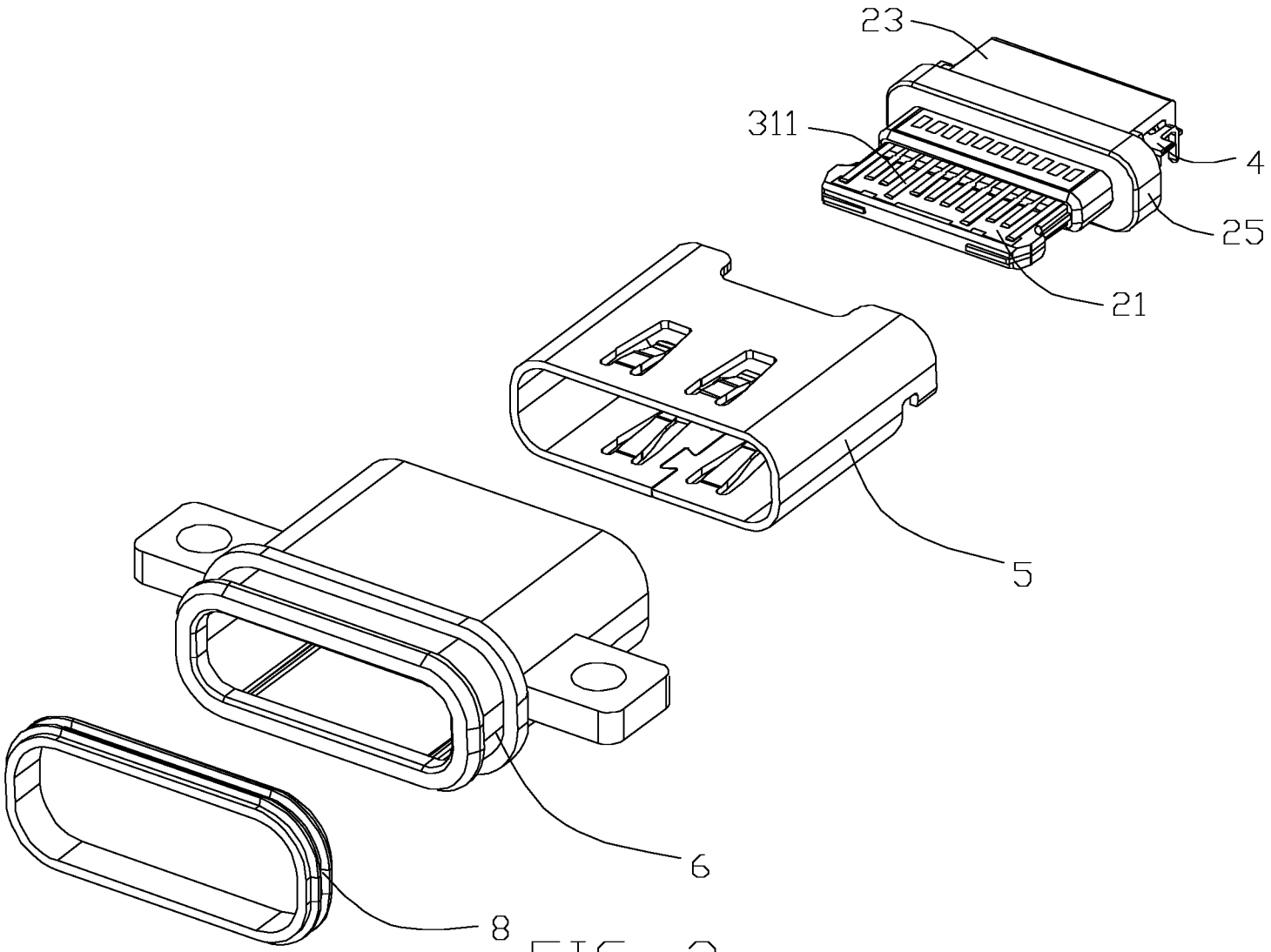
FIG. 3 is an exploded view of the electrical connector assembly.
Figure 4:
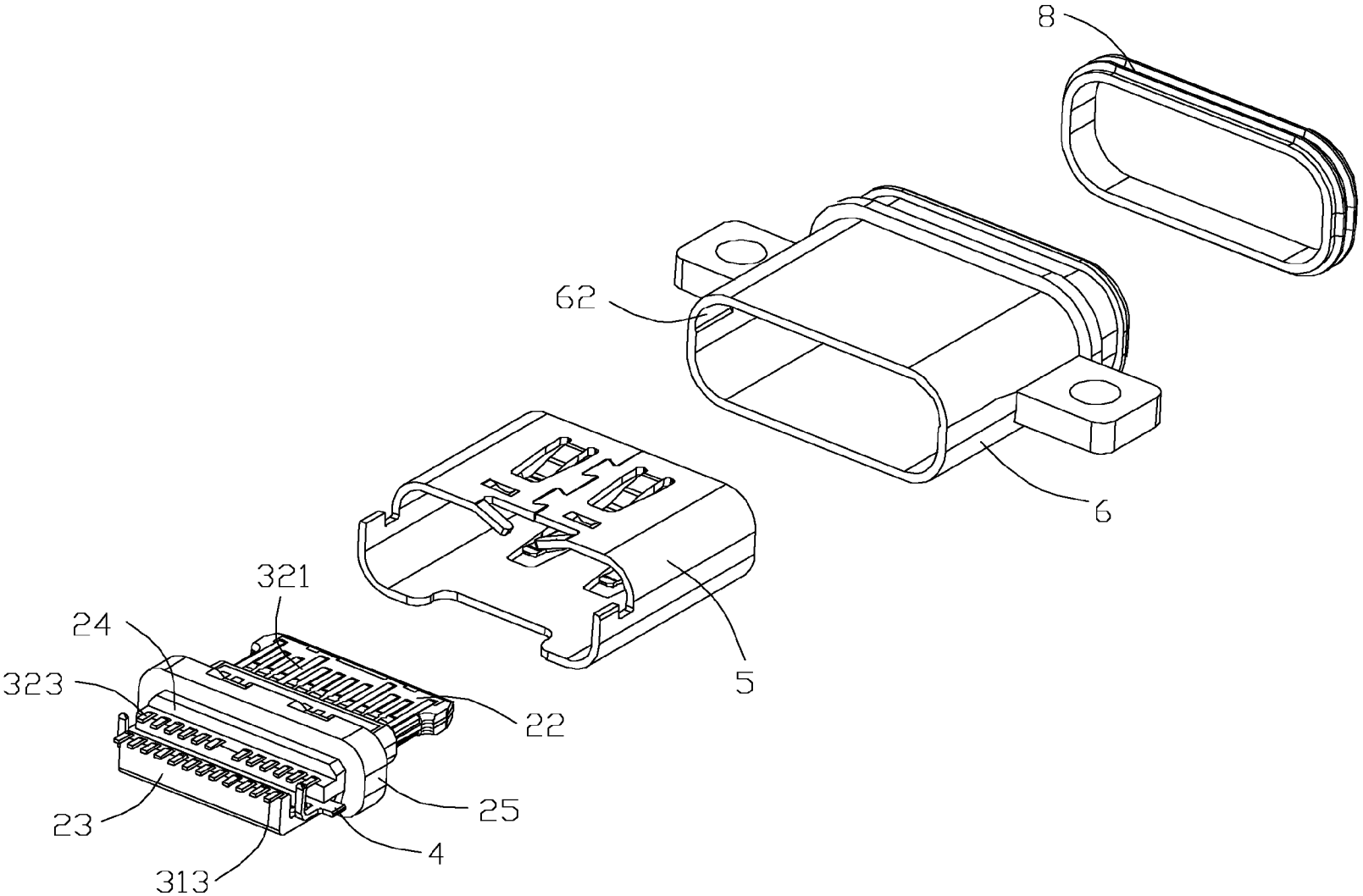
FIG. 4 is another exploded view of the electrical connector assembly.
Figure 5:
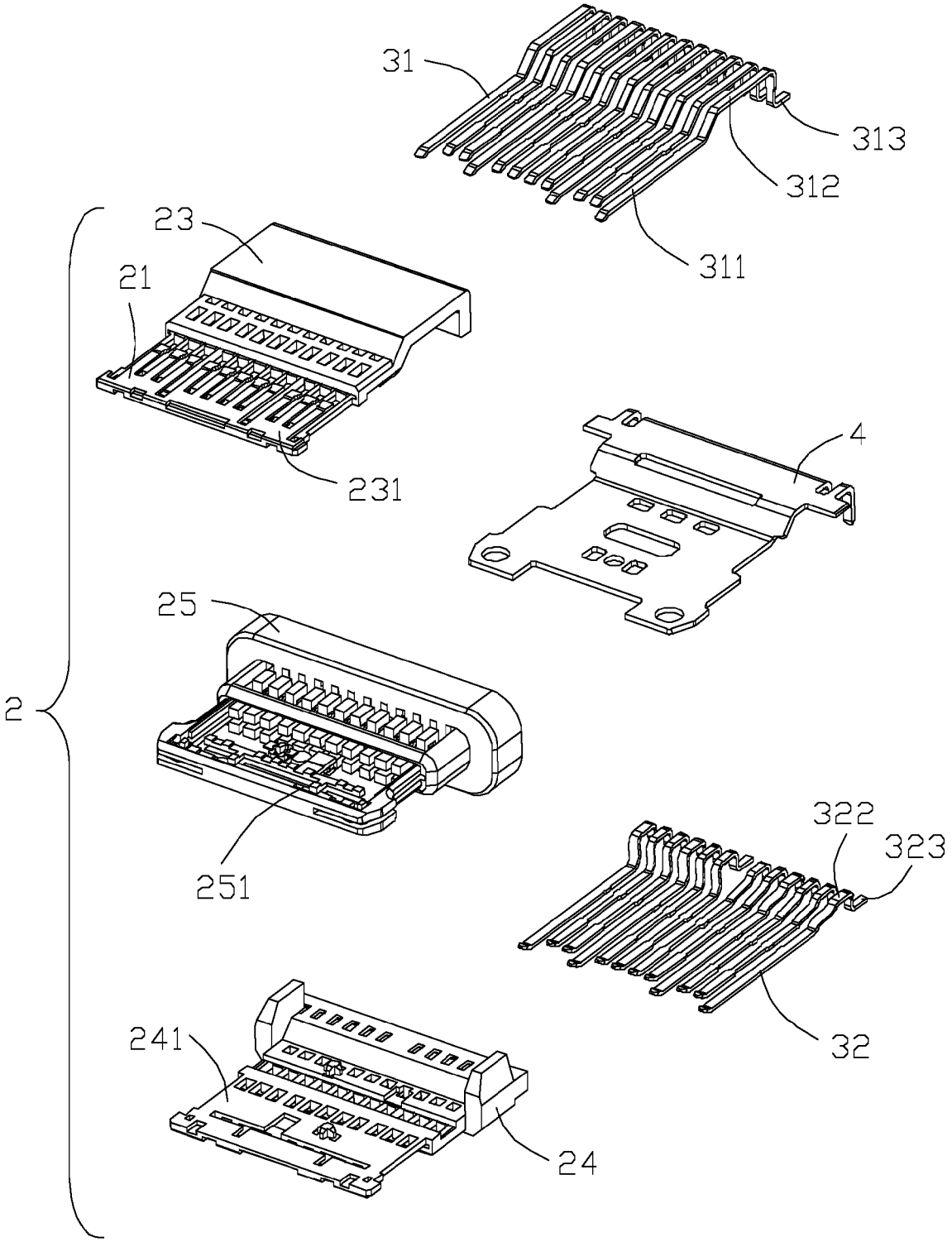
FIG. 5 is an exploded view of a housing and contacts of the electrical connector assembly.
Figure 6:
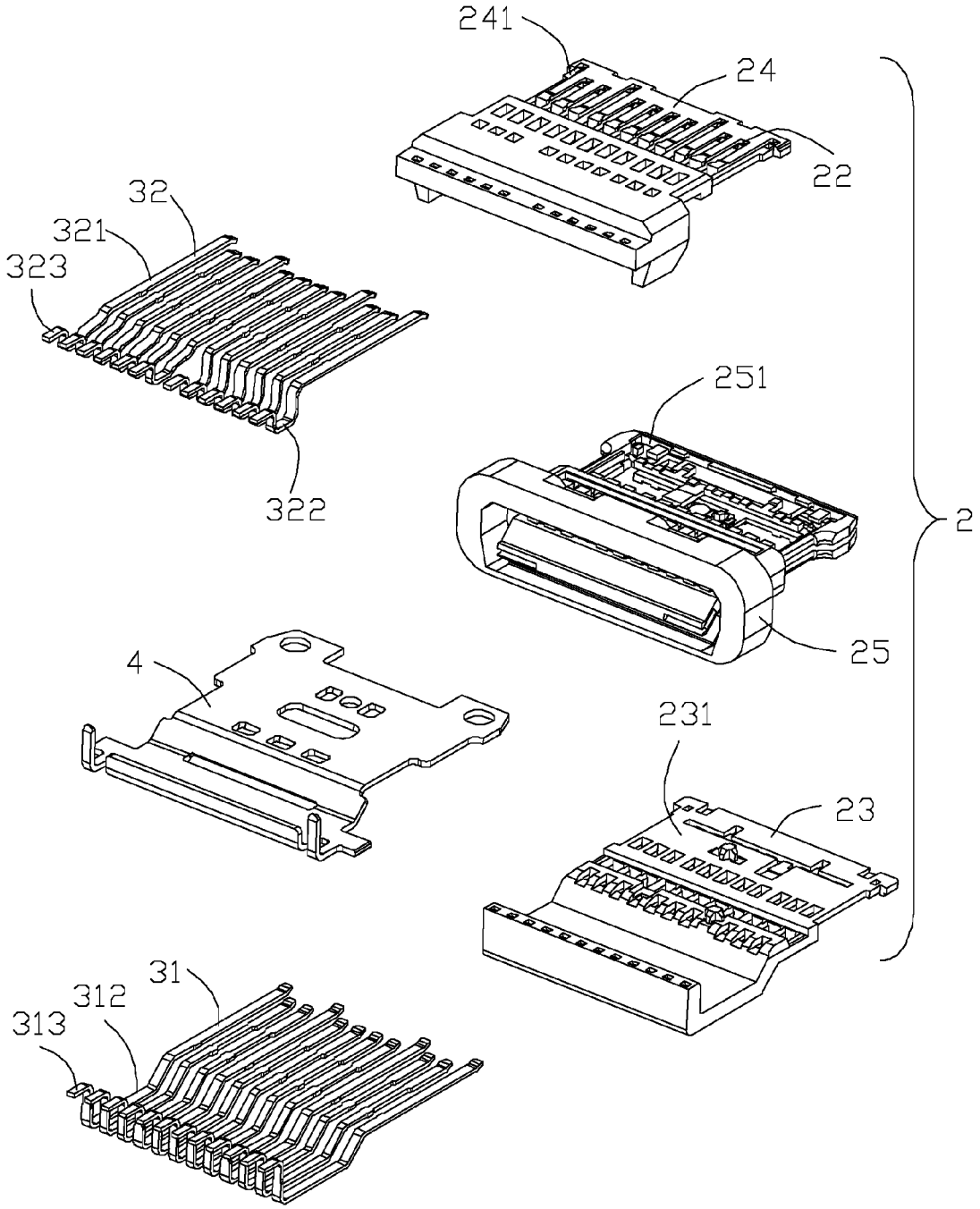
FIG. 6 is another exploded view of the housing and the contacts.
Figure 7:
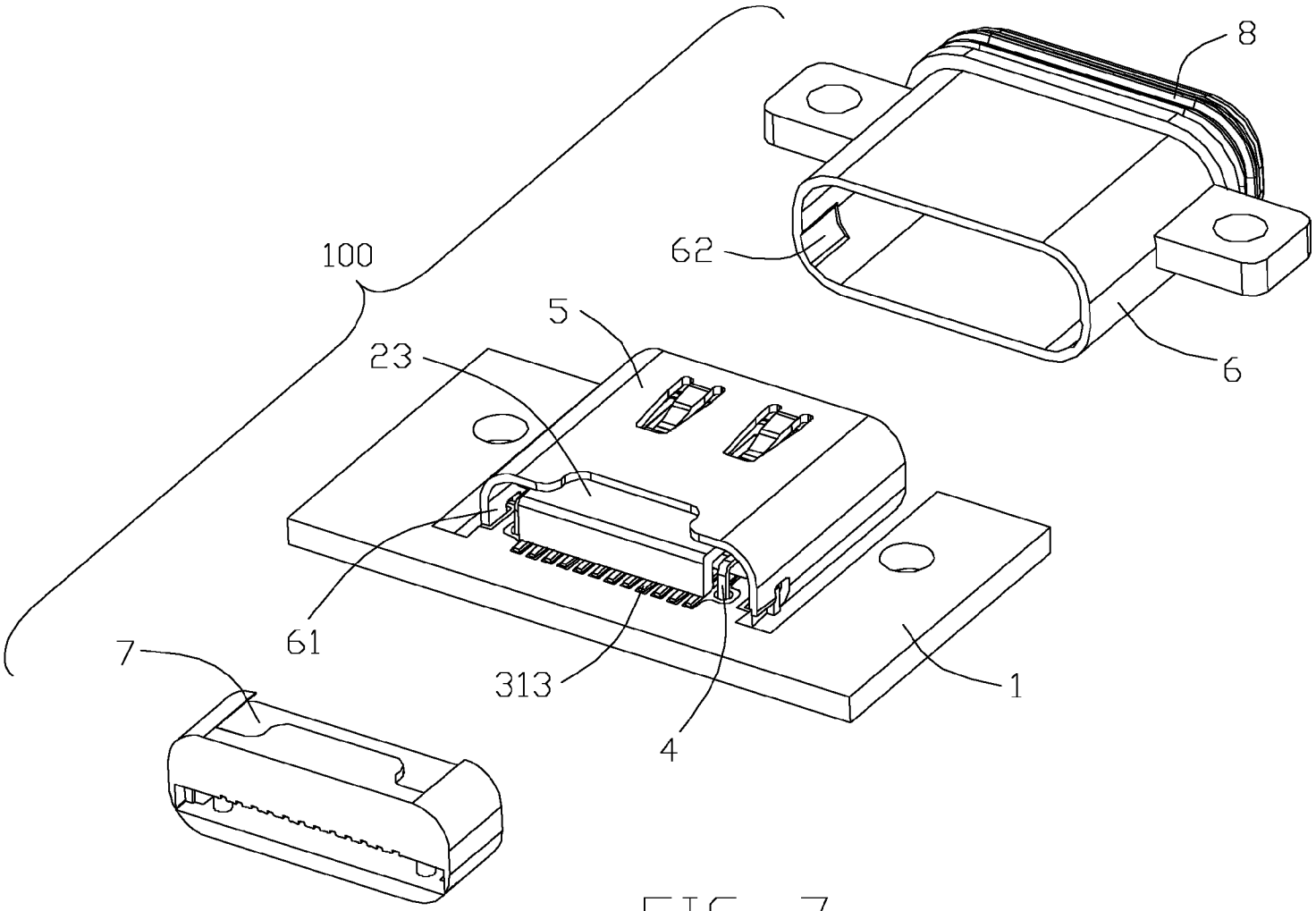
FIG. 7 is a perspective view of the electrical connector assembly schematically showing a cover thereof at a state prior to mounting to a shield thereof to form a sealing structure.
Figure 8:
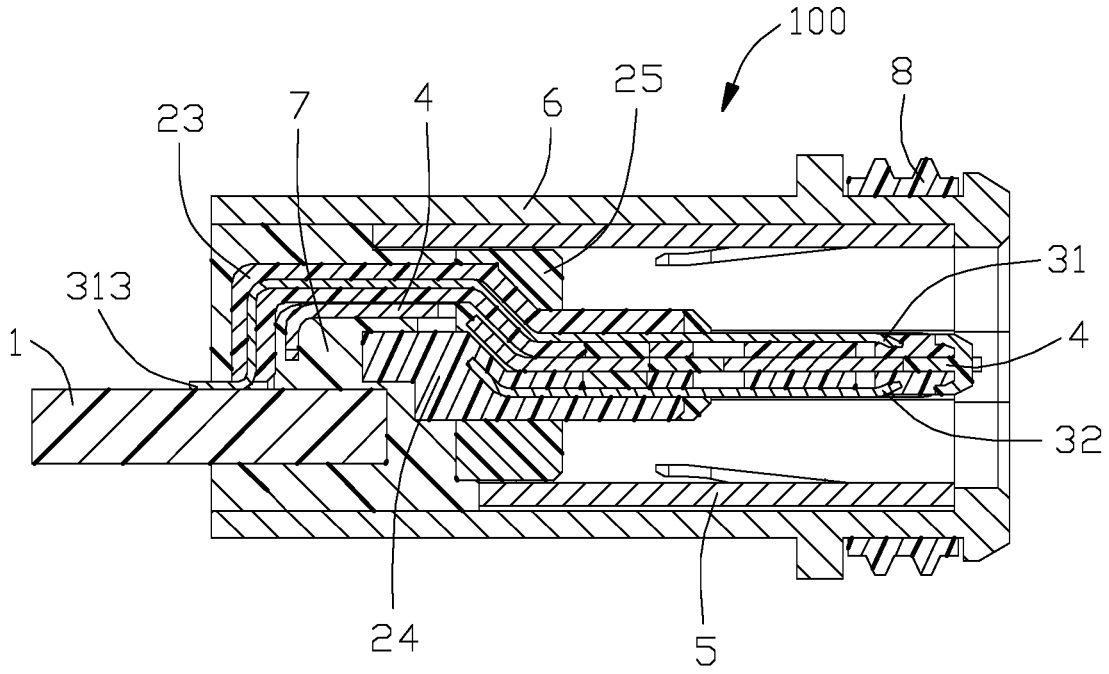
FIG. 8 is a cross-sectional view of the electrical connector assembly along line A-A in FIG. 2.

Referring specifically to FIGS. 2 and 7-8, the sealing member 7 is formed by applying epoxy or like material in the chamber 61 and solidifying the same. Therefore, the member 7 seals gaps among rear ends of the upper and lower pieces 23 and 24, the soldering portions 313 and 323 of the upper and lower rows of contacts 31 and 32, rear end of the shield 5, the edge portion of the substrate 5, and the cover 6.

The steps of manufacturing the electrical connector assembly 100 are as follows: mounting the metallic shield 5 to a combined insulative housing 2 and electrical contacts 31 and 32; connecting the substrate 1 to the electrical contacts 31 and 32; enclosing the insulative cover 6 over the shield 5 and an edge portion of the substrate 1 to define the chamber 61; and sealing the chamber 61.

The substrate 1 may suitably be a mother board or a daughter board to be electrically connected to another mother board.

In the present invention, because the insulative cover 6 is mounted to the metallic shield 5 after the substrate 1 extends into the chamber 61 and is soldered to the contacts 3, the sealing member 7 may be advantageously formed in the chamber 61. Notably, in this embodiment the chamber 61 is formed by cooperation of the cover 6, the housing 2 and the shield 5. Anyhow, if the shield 5 extends further rearwardly to cover the rear portion of the upper piece 23 in the vertical direction, the chamber 61 may be formed by the shield 5 and the housing 2 only instead.

What is claimed is:

1. A waterproof electrical connector assembly comprising:

an insulative housing;

a plurality of contacts retained to the housing;

a metallic shield secured to the housing;

an insulative cover enclosing the shield to define a rear chamber;

a substrate connected to the contacts and having an edge portion, the edge portion extending forwardly into the rear chamber; and a sealing member filling the rear chamber; wherein the edge portion of the substrate is embedded in the sealing member.

2. The waterproof electrical connector assembly according to claim 1, wherein the substrate is soldered to the contacts.

3. A method for manufacturing a waterproof electrical connector assembly, comprising the steps of:

mounting a metallic shield to a combined insulative housing and electrical contacts;

connecting a substrate to the electrical contacts;

enclosing an insulative cover over the shield and an edge portion of the substrate to define a chamber; and sealing the chamber via a sealing member and embedding the edge portion in the sealing member.

4. The method according to claim 3, wherein the step of connecting comprises soldering the electrical contacts to the substrate.

5. A waterproof electrical connector comprising:

a terminal module including a plurality of upper contacts, a plurality of lower contacts and a metallic shielding plate therebetween all commonly integrally assembled together by an insulating member via at least one insert-molding process;

a metallic shield enclosing said terminal module and forming a front mating cavity communicating with an exterior along a front-to-back direction for receiving a plug;

an insulative cover enclosing the shield;

a rear chamber formed and confined by the terminal module and at least one of said shield and said cover, said rear chamber and said front mating cavity essentially being separated from each other by the terminal module in the front-to-back direction;

a printed circuit board (PCB) including a front edge region disposed within the rear chamber and a rear edge region exposed outside of the rear chamber, the upper contacts and the lower contacts being electrically and mechanically connected to the front edge region; and a sealing member completely filling remaining space of the rear chamber after the PCB is assembled to the terminal module so as to have the front edge region of the PCB embedded in the sealing member.

6. The waterproof electrical connector as claimed in claim 5, wherein said cover is applied upon the shield after the PCB is assembled to the terminal module, and said sealing member fills the remaining space of the rear chamber after the cover is applied upon the shield.

7. The waterproof electrical connector as claimed in claim 5, wherein said upper contacts are integrally assembled within an upper terminal module via a first step insert-molding process, said lower contacts are integrally assembled within a lower terminal module via another first step insert-molding process, and both said upper terminal module and said lower terminal module cooperate with the shielding plate to form the final terminal module via a second step insert-molding process.

8. The waterproof electrical connector assembly as claimed in claim 7, wherein said sealing member fully covers the upper terminal module and the lower terminal module.

9. The waterproof electrical connector assembly as claimed in claim 5, wherein both opposite upper and lower surfaces of the PCB are covered by the sealing member around the front edge region.

10. The waterproof electrical connector assembly as claimed in claim 5, wherein said shield includes a plurality of spring arms extending into the mating cavity while being covered by the cover in a vertical direction perpendicular to said front-to-back direction.

11. The waterproof electrical connector assembly as claimed in claim 5, wherein said PCB extends along the front-to-back direction.

* * * * *